US008033802B2

(12) United States Patent
Tekneyan et al.

(10) Patent No.: US 8,033,802 B2
(45) Date of Patent: Oct. 11, 2011

(54) STATOR CASING FOR ECCENTRIC WORM PUMPS

(75) Inventors: Mikael Tekneyan, Waldkraiburg (DE); Helmuth Weber, Simbach am Inn (DE); Johann Kreidl, Waldkraiburg (DE); Hisham Kamal, Waldkraiburg (DE)

(73) Assignee: NETZSCH-Mohnopumpen GmbH (DE)

( * ) Notice: Subject to any disclaimer, the term of this patent is extended or adjusted under 35 U.S.C. 154(b) by 343 days.

(21) Appl. No.: 12/268,078

(22) Filed: Nov. 10, 2008

(65) Prior Publication Data

US 2009/0074599 A1 Mar. 19, 2009

Related U.S. Application Data

(63) Continuation of application No. PCT/DE2007/000845, filed on May 10, 2007.

(30) Foreign Application Priority Data

May 11, 2006 (DE) ..... 10 2006 021 897

(51) Int. Cl.

| | |
|---|---|
| ***F01C 1/10*** | (2006.01) |
| ***F01C 5/00*** | (2006.01) |
| ***F03C 2/00*** | (2006.01) |
| ***F04C 2/00*** | (2006.01) |

(52) U.S. Cl. ..... 418/48; 418/152; 418/153; 418/179

(58) Field of Classification Search ..... 418/48, 418/152, 153, 178, 179

See application file for complete search history.

(56) References Cited

U.S. PATENT DOCUMENTS

| | | | | |
|---|---|---|---|---|
| 3,011,445 | A * | 12/1961 | Bourke | 418/48 |
| 3,489,231 | A * | 1/1970 | Tschirky et al. | 418/48 |
| 4,025,751 | A * | 5/1977 | Wright | 219/216 |
| 2005/0147516 | A1 * | 7/2005 | Kamal et al. | 418/48 |
| 2007/0059191 | A1 * | 3/2007 | Kreidl et al. | 418/48 |

FOREIGN PATENT DOCUMENTS

| | | | |
|---|---|---|---|
| DE | 15 53 126 | A1 | 3/1971 |
| DE | 29 07 392 | A1 | 8/1980 |
| DE | 198 21 065 | A1 | 11/1999 |
| DE | 102 41 753 | A1 | 11/2003 |

OTHER PUBLICATIONS

International Search Report, Sep. 6, 2007, 2 pages.

* cited by examiner

*Primary Examiner* — Theresa Trieu

(74) *Attorney, Agent, or Firm* — St. Onge Steward Johnston & Reens LLC

(57) ABSTRACT

The invention relates to a stator casing for eccentric worm pumps comprising an elastic lining, the cylindrical stator casing having a surface on the inner side, along the longitudinal axis whereof grooves are incorporated.

20 Claims, 5 Drawing Sheets

STATOR CASING FOR ECCENTRIC WORM PUMPS

CROSS-REFERENCE TO RELATED APPLICATIONS

The present application is a continuation of pending International patent application PCT/DE2007/000845 filed on May 10, 2007 which designates the United States and claims priority from German patent application 10 2006 021 897.3 filed on May 11, 2006, the content of which is incorporated herein by reference.

FIELD OF THE INVENTION

The invention relates to a stator for an eccentric worm pump which consists of a stator casing and an elastic lining disposed movably in the stator casing.

BACKGROUND OF THE INVENTION

A stator whose stator casing and lining are configured in a spiral shape is deduced in this regard from DE 198 21 065 A1. Both parts are screwed together, whereby any twisting during operation of the pump should be avoided. It is also deduced from this document that stator combinations in which the stator casing has projecting strips on its inner side which engage in grooves on the surface of the lining, prevent any twisting of both components.

FIG. 4 of DE 1553126 A1 discloses a polygonal lining which is surrounded by a likewise polygonal-shaped stator casing. In this example, the lining is not vulcanised-in but a withdrawal device is required to remove it from the pump casing.

A configuration to improve the adhesive effect of the lining with the stator casing can be deduced from DE 29 07 392 A1. For this purpose, the basically round inner surface of the stator casing has a plurality of groove-shaped indentations in which the elastic material of the lining is vulcanised. No axial mobility of the lining is thereby provided.

However, these exemplary embodiments neglect the fact that the pressure produced in the pump during pumping presses the lining very firmly against the stator casing which can then only be moved, removed or exchanged subsequently and during operation of the pump with a very expenditure of force and in most cases not without mechanical aids.

It is therefore the object of the invention to configure the stator casing such that adhesion of the lining is counteracted.

SUMMARY OF THE INVENTION

This object is achieved by the stator casing provided by the invention.

Depending on the pressure ratios, products and materials with which an eccentric worm pump is operated, loads are produced on the lining. These loads can naturally result in exchange or correction of the position of the lining earlier or later. In addition, the axial mobility of the stator lining in the stator casing can be necessary for optimum adjustment of the stator dimensions. With the structure of the conventional stator combinations, exchanging the lining or positional compensation is only possible with great difficulty since the stator lining abuts very tightly against the inner surface of the stator casing. Even when the lining abuts against the stator casing free from binders, the forces of attraction or suction produced or caused require high opposing forces to remove the lining from the stator casing or to keep it movable in relation to said casing. According to the invention, the required opposing forces are almost eliminated by reducing the adhesive forces, for which grooves are inserted in the surface of the inner side of the stator casing. Thus, the stator lining also retains its axial mobility during pumping operation.

In a preferred embodiment, the grooves run on the inner surface of the stator casing parallel to its longitudinal axis. The adhesive effect is uniformly cancelled out thereby or with the spiral arrangement of the grooves.

According to a further embodiment, the cross-section of the grooves is adapted to different elastic materials for the stator lining. Thus, when using highly elastic material and V-shaped grooves, the release process can take place more efficiently than with angular-shaped or swallowtail-shaped grooves. This groove shape is in turn better suited for low-elasticity material since the depth of penetration can be kept small here.

It has been shown that depth and width ratios in the range of 1:1 to 2:1 are very well suited to safeguard the stator insert from twisting during operation of the pump and on the other hand, to positively support the separation process. Should the lining not become detached from the stator casing, the stator alone could be inserted between an end plate and a pressure medium storage device. The subsequent introduction of the pressure means (gas, liquid) into the grooves would initiate and accelerate the release process.

A further exemplary embodiment of the invention relates to the polygonal cross-sectional shape of the stator casing and the lining. Depending on which conveying cross-section is required by the eccentric worm pump and what friction is produced by the rotor in the stator, compensation must take place between the force produced in the area of the grooves and the area of the edges between the polygonal casing surfaces, in order to avoid undesirable wear of the lining. The polygonal configuration of the stator casing serves here as optimal fixing of the stator lining. A uniform distribution of the loading takes place above an edge number of 8 edges upwards.

Special numbers of grooves and groove shapes are possible depending on the pump capacity and delivery pressure. With all groove shapes, care should be taken to ensure that all the radii of the grooves do not fall below a radius of 0.2 mm so that deformation and re-formation of the lining material is not impeded.

Special products which are pumped at specific temperature influence the stator lining differently in the partial areas. Thus, according to a further embodiment according to the invention, it can be advantageous if at least every other polygonal surface has grooves or if at least one groove is inserted in the polygonal surfaces. The different pressure regions of the stator casing can also be configured differently. Thus, for example, the number of grooves can be increased or their width or depth increased, in areas of higher delivery or counter-pressure values.

To simplify mounting and dismounting of the stator linings, the stator casing can have a continuous slit over the entire length which allows a slight widening. The slit can be covered and reduced by a closure strip during operation of the pump. In the operating state, the stator casing is therefore under a pre-stress which is released on removing the closure strip and thus expands the diameter of the stator casing.

According to a further exemplary embodiment, the longitudinal dimension of the lining after manufacture is greater than in the built-in state of the lining in the eccentric worm pump when ready for operation.

According to another exemplary embodiment, the closure strip has a conduit system with which a fluid can be pressed between the stator casing and the lining.

BRIEF DESCRIPTION OF THE DRAWINGS

Examples of the invention can be seen from the following drawings. In the figures.

DETAILED DESCRIPTION OF THE INVENTION

Certain embodiments of the invention are directed to a polygonal stator casing for eccentric worm pumps comprising: an elastic lining on the inner surface of the stator casing, the elastic lining abutting in an axially movable manner, wherein at least one groove is inserted in the individual polygonal faces of the stator casing, which reduces the adhesive effect between the elastic lining and the stator casing.

The stator casing may have the grooves disposed parallel to the longitudinal axis. The stator casing may have the grooves formed to be rectangular, V-shaped, round or angular in cross-section. The stator casing may have the ratio of groove depth to groove width 1:1. The stator casing may have the ratio of groove depth to groove width is >1. The stator casing may have at least every other polygonal surface has grooves.

The stator casing may have a continuous slit. The stator casing may have the slip covered with a closure strip. The stator casing may have the closure strip and the stator casing form longitudinal grooves. The stator casing may have the closure strip extending along its longitudinal axis. The stator casing may have the inner surface of the stator casing have anti-adhesive coating.

The stator casing may have the closure strip consists of the same or different materials (plastic, aluminum, chromium nickel steel) as the stator casing. The inner surface of the stator casing may be roughened, for example, by means of sand blasting. The outer surface of the lining may have an anti-adhesive coating.

The outer surface of the stator casing may be provided with ribs along the longitudinal axis. The ratio of the groove depth to groove width may be 1:1. The ratio of the groove depth to groove width may be >1. The ratio of the groove depth to groove width may be 1.5:1.

Figure 1:
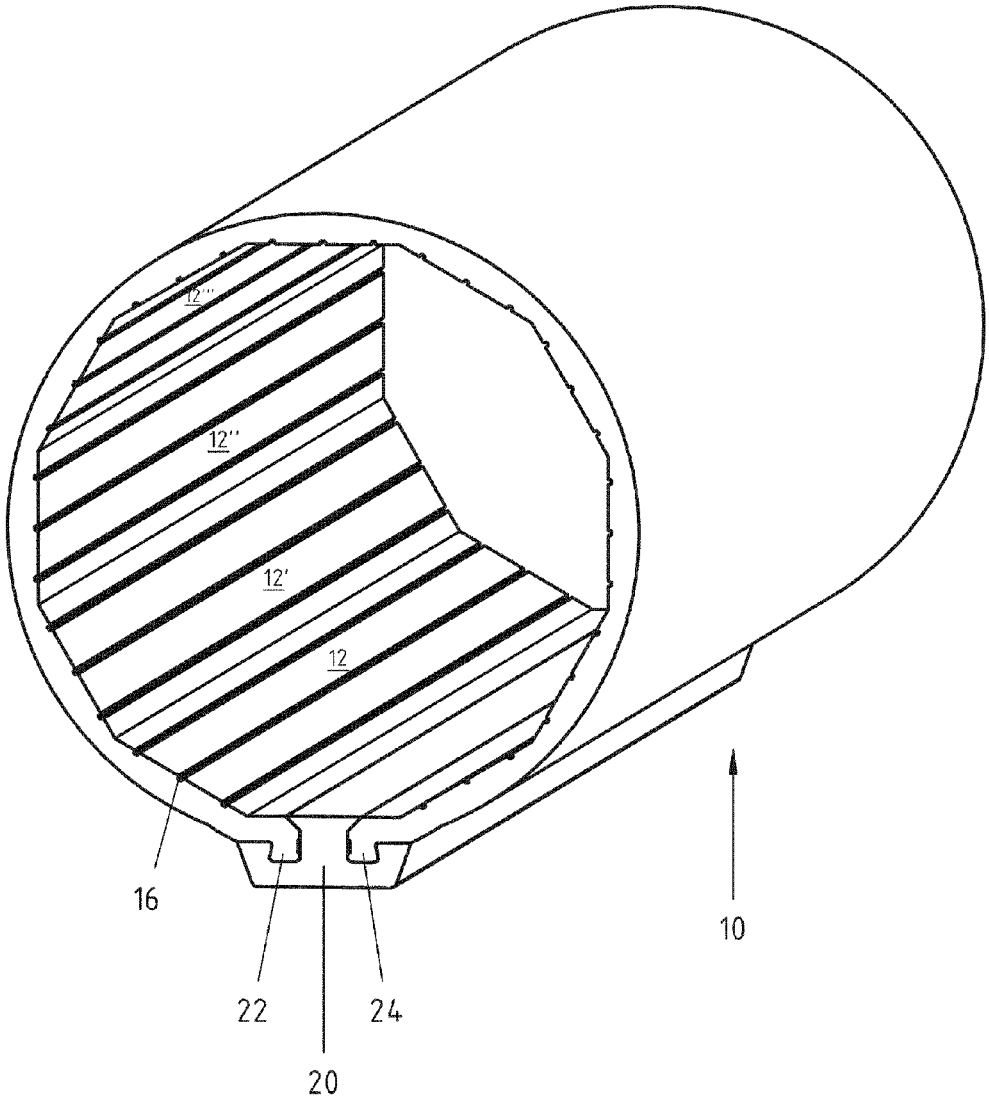
FIG. 1 shows a stator casing for an eccentric worm pump.

FIG. 1 shows a stator casing 10 having a smooth cylindrical surface as is usual in the hitherto known prior art. The inner surface of the stator casing is configured to be polygonal-shaped. Twelve surfaces 12 flat both in their length and in their width are arranged around the inner circumference of the stator casing. Two surfaces are continuously delimited by an interposed edge 14 or are interconnected by an edge 14. In this exemplary embodiment, each surface 12 has three grooves 16. The grooves run parallel to one another along the longitudinal axis of the stator casing 10. The distance of the grooves 16 from one another is same on each and with respect to each surface 12, 12', 12", 12''' etc. A longitudinal slit 36 whose width is dependent, inter alia, on the diameter and the elasticity of the lining 18, divides the stator casing on one side.

A closure strip 20 makes a positive connection with these two ends 22, 24 and thus ensures that the stator casing does not expand during operation of the pump. In order that the desired anti-adhesion properties remain uniform over the entire inner circumference which is ensured by the inserted grooves 16, the strip can also be provided with a groove. In order that the plane profile of the inner surfaces 12, 12', 12" is retained, the ends 22, 24 are outwardly curved, whereby the closure strip forms a tight fit in the outer region and is integrated internally in the surface profile.

Figure 1A:
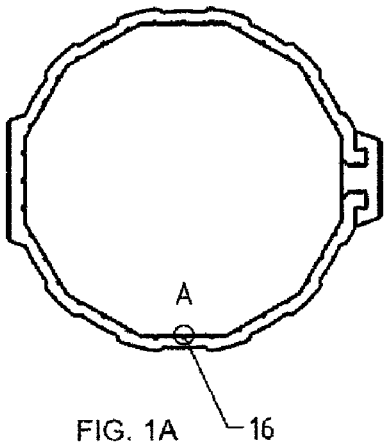
FIG. 1A shows a side view of FIG. 1.
Figure 1B:
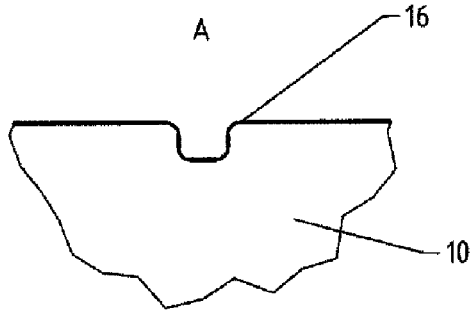
FIG. 1B shows an exploded view across crosscut A of FIG. 1A.
Figure 1C:
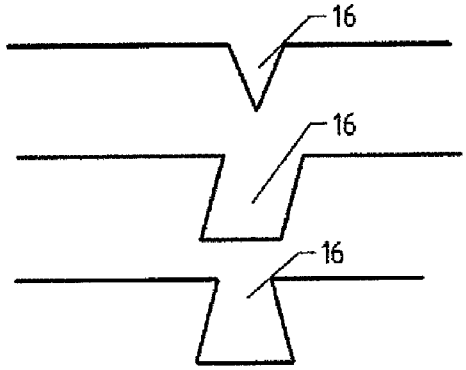
FIG. 1C shows a exploded view of various grooves shown in across crosscut A of FIG. 1A.

FIG. 1A shows a side view of FIG. 1. Here, crosscut A is provided where grooves 16 are shown. FIG. 1B is an exploded view of crosscut A of FIGS. 1 and 1A, showing an exploded view of grooves 16 as well as stator casing 10. FIG. 1C shows three different grooves 16, the first being a V-shaped groove, the second being a rectangular groove, and the third being angular in cross section.

Figure 2:
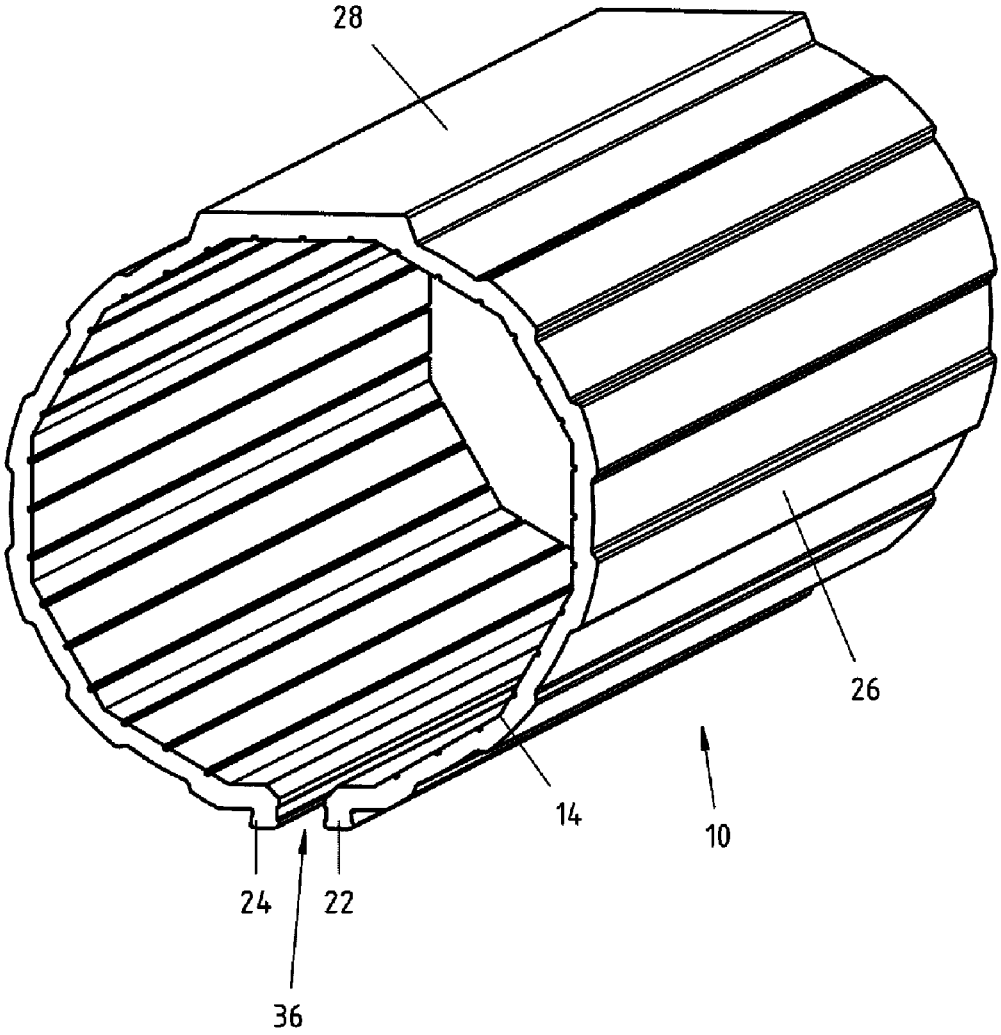
FIG. 2 shows a stator casing for an eccentric worm pump.

FIG. 2 shows a stator casing having fundamentally the same structure as in FIG. 1. As a result of its naturally smaller diameter compared with FIG. 1, here only 10 polygonally arranged surfaces 12 form the inner surface of the stator casing. In accordance with the smaller capacity required with smaller pumps and counter-pressure depending on the pump head, a double groove arrangement per polygonal surface is provided for this size. As a result of the reduction in the material thickness in the area of the edges, the region is reinforced with ribs 26. The rib width corresponds to the spacing of the grooves 16. Both the ribs 26 and also the platform 28 are provided as a centring aid and as protection from twisting. FIG. 2 shows the stator casing without closure strip with opened longitudinal slit 36.

Figure 3:
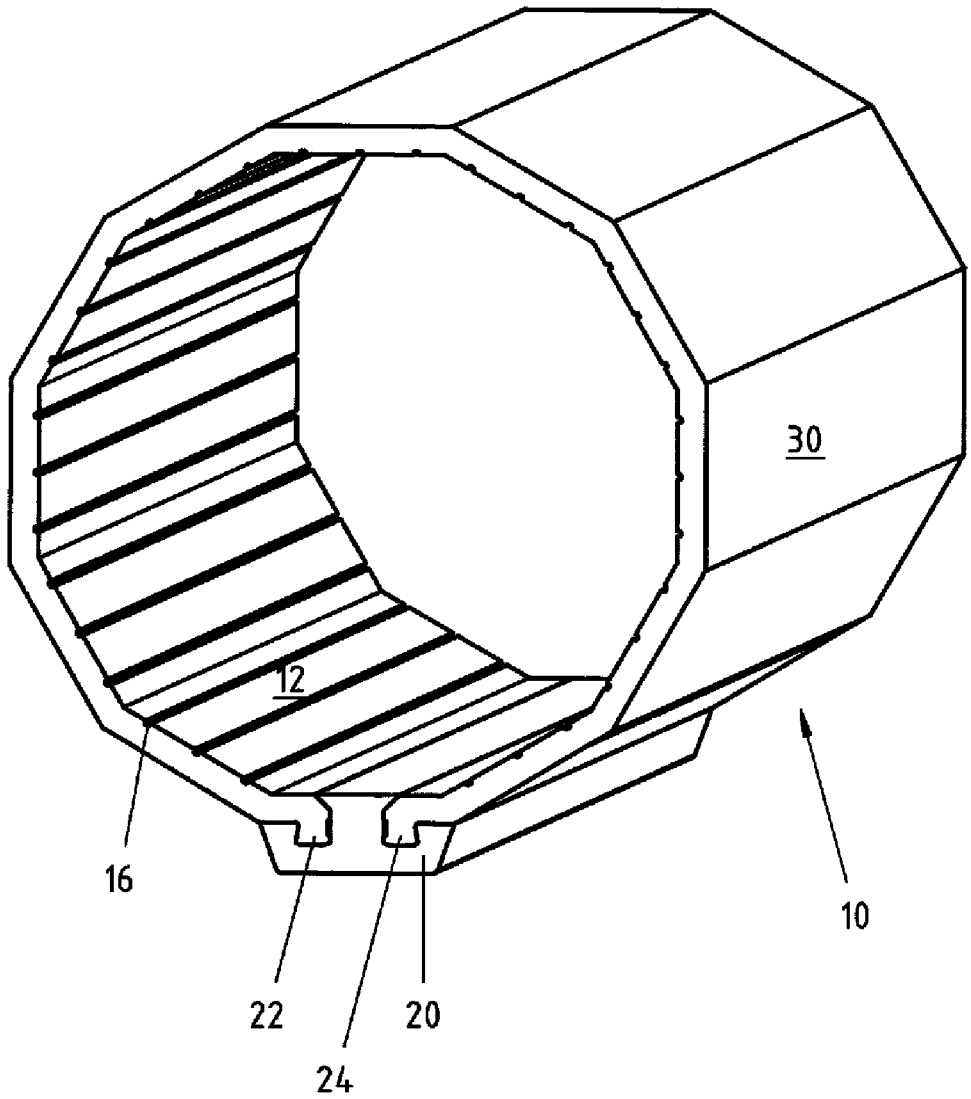
FIG. 3 shows a stator casing for an eccentric worm pump.

The stator casing 10 according to FIG. 3 is configured as polygonal-shaped on its inner and outer side. The inner surfaces 12 and outer surfaces 30 are arranged to be coincident. All the inner surfaces 12 each have three grooves 16 at the same distances from one another. If the strength of the closure strip is selected to be smaller than that of the stator casing, the closure strip at the same time fulfils the function of a safeguard against excess pressure.

Figure 4:
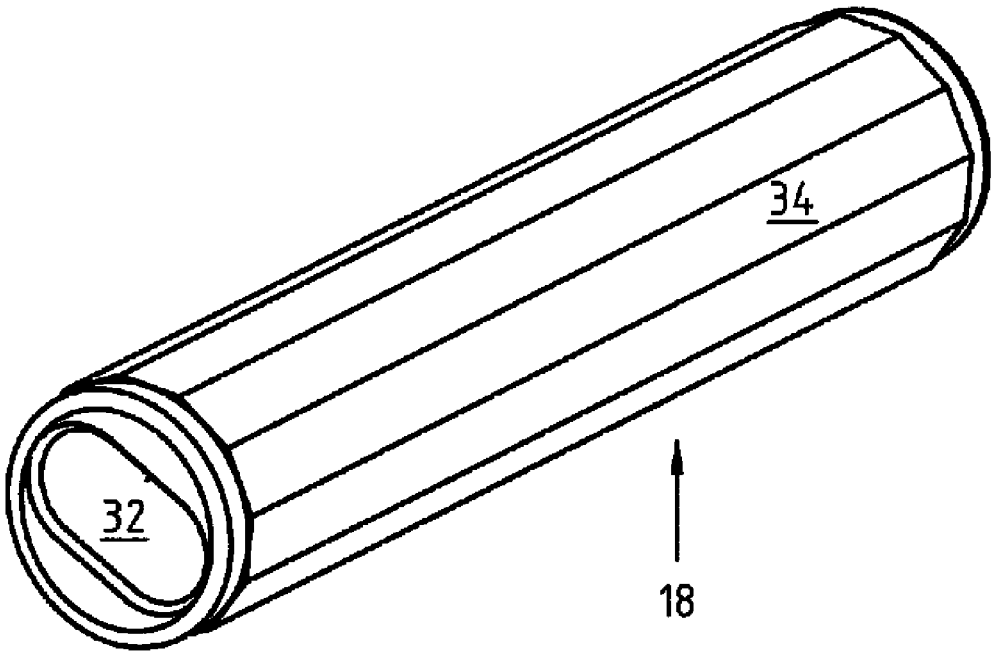
FIG. 4 shows a lining for a stator casing.

FIG. 4 shows a lining 18 of the stator casing 10. A cavity 32 with a multiple thread in which the rotor of the pump revolves, extends through the interior of the lining. The outer surface of the lining is polygonal-shaped and has for this purpose a plurality of outer surfaces 34 arranged parallel to one another. The length of the lining in the dismantled state is always larger than that of the stator casing. As a result, on insertion into the stator casing or into the eccentric worm pump, the stator lining is axially compressed and acquires the necessary nominal dimensions for the pump cavity. The outside diameter of the stator lining accordingly has an undersize in the dismantled state.

What is claimed is:

1. A stator casing for eccentric worm pumps comprising:

an inner surface having individual polygonal faces, and an elastic lining, the elastic lining abutting the inner surface of the stator casing in an axially movable manner, wherein at least one groove is inserted in the individual polygonal faces of the inner surface of the stator casing, the at least one groove reducing the adhesive effect between the elastic lining and the inner surface of the stator casing.

2. The stator casing of claim 1, wherein the stator casing has a longitudinal axis, and wherein the grooves are disposed parallel to the longitudinal axis.

3. The stator casing of claim 2, wherein groove depth to groove width has a ratio of 1:1.

4. The stator casing of claim 2, wherein groove depth to groove width has a ratio of >1.

5. The stator casing of claim 1, wherein the grooves are formed to be rectangular, V-shaped, round or angular in cross-section.

6. The stator casing of claim 1, wherein groove depth to groove width has a ratio of 1:1.

7. The stator casing of claim 1, wherein groove depth to groove width has a ratio of >1.

8. The stator casing of claim 7, wherein the ratio of groove depth to groove width is 1.5:1.

9. The stator casing of claim 1, wherein at least every other polygonal surface has grooves.

10. The stator casing of claim 1, wherein the stator casing has a continuous slit.

11. The stator casing of claim 10, wherein the slit is covered with a closure strip.

12. The stator casing of claim 11, wherein the closure strip and the stator casing form longitudinal grooves.

13. The stator casing of claim 11, wherein the closure strip consists of the same or different materials (plastic, aluminum, chromium nickel steel) as the stator casing.

14. The stator casing of claim 1, wherein the stator casing has a closure strip extending along its longitudinal axis.

15. The stator casing of claim 1, wherein the inner surface of the stator casing has an anti-adhesive coating.

16. The stator casing of claim 15, wherein in that the anti-adhesive coating is PTFE varnish.

17. The stator casing of claim 1, wherein the inner surface is roughened by sand blasting.

18. The stator casing of claim 1, wherein the outer surface of the lining has an anti-adhesive coating.

19. The stator casing of claim 18, wherein the anti-adhesive coating is PTFE varnish.

20. The stator casing of claim 1, wherein the outer surface of the stator casing is provided with ribs along the longitudinal axis.

* * * * *